US007768538B2

(12) United States Patent
Kettle et al.

(10) Patent No.: US 7,768,538 B2
(45) Date of Patent: Aug. 3, 2010

(54) HYBRID DATA PLANES

(75) Inventors: Wiatt E. Kettle, Corvallis, OR (US); Brett E. Dahlgren, Lebanon, OR (US); Matthew J. Gelhaus, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1165 days.

(21) Appl. No.: 11/124,795

(22) Filed: May 9, 2005

(65) Prior Publication Data

US 2006/0250423 A1 Nov. 9, 2006

(51) Int. Cl.
*G09G 5/10* (2006.01)

(52) U.S. Cl. ..... 345/690; 345/692

(58) Field of Classification Search ..... 345/84, 345/87–90, 163, 213, 419, 561, 656, 568, 345/692, 589, 204, 214, 43, 48, 531, 653, 345/30, 6, 7, 619, 613, 690, 611, 634, 564; 359/629, 291, 630; 341/62, 90, 65; 382/240, 382/250, 303

See application file for complete search history.

(56) References Cited

U.S. PATENT DOCUMENTS 4,601,055 A * 7/1986 Kent ..... 382/303
4,700,181 A * 10/1987 Maine et al. ..... 345/539
4,755,810 A * 7/1988 Knierim ..... 345/564
4,841,292 A * 6/1989 Zeno ..... 345/419
4,882,683 A * 11/1989 Rupp et al. ..... 345/568
4,908,780 A * 3/1990 Priem et al. ..... 345/611
4,958,146 A * 9/1990 Priem et al. ..... 345/634
5,136,524 A * 8/1992 Priem et al. ..... 345/561
5,663,749 A * 9/1997 Farris et al. ..... 348/771
5,734,362 A * 3/1998 Eglit ..... 345/89
5,969,710 A 10/1999 Doherty et al.
5,990,982 A * 11/1999 Gove et al. ..... 348/750
6,064,404 A * 5/2000 Aras et al. ..... 345/530
6,307,369 B1 * 10/2001 Felmlee et al. ..... 324/309
6,339,417 B1 * 1/2002 Quanrud ..... 345/98
6,590,852 B1 * 7/2003 McCormick, Jr. ..... 369/112.23
6,774,916 B2 8/2004 Pettitt et al.
6,978,048 B1 * 12/2005 Higginbottom et al. ..... 382/240
6,985,526 B2 * 1/2006 Bottreau et al. ..... 375/240.1
7,088,324 B2 * 8/2006 Sakaguchi et al. ..... 345/87
7,477,246 B2 * 1/2009 Winer et al. ..... 345/213
7,511,717 B1 * 3/2009 Bastos et al. ..... 345/613
2003/0231194 A1 12/2003 Morgen et al.
2005/0083218 A1 * 4/2005 Regunathan et al. ..... 341/65
2005/0219173 A1 * 10/2005 Kettle et al. ..... 345/84
2006/0061600 A1 * 3/2006 Beuker et al. ..... 345/656
2007/0109266 A1 * 5/2007 Davis et al. ..... 345/163

OTHER PUBLICATIONS

NN84046130 Reduced Logic for Boolean Operations on Raster Display Refresh Buffers IBM Technical Disclosure Bulletin, Apr. 1984, US vol. No. 26 Issue No. 11 p. No. 6130-6131 Publication-Date: Apr. 1, 1984 Cross Reference: 0018-8689-26-11-6130.*

* cited by examiner

*Primary Examiner*—Prabodh Dharia

(57) ABSTRACT

One embodiment provides a method that includes displaying Boolean combinations of two or more bit planes.

36 Claims, 5 Drawing Sheets

HYBRID PLANE (1)

HYBRID PLANE (2)

HYBRID PLANE (3)

HYBRID DATA PLANES

BACKGROUND

Pulse-modulated micro-displays (PMMs) require pulse modulation over time to generate gray levels because they are essentially on/off devices. The basic drive algorithms used to drive pulse-modulated micro-displays involve breaking source images into binary weighted bit planes and then displaying each bit plane one at a time within a source frame. The observer's eyes integrate the result into a gray level and/or color. For some applications, pulse-modulated micro-displays are used in series, e.g., for enhancing contrast. This can result in visual discontinuities or noticeable artifacts when using the basic binary weighted bit plane drive algorithms.

DETAILED DESCRIPTION

In the following detailed description of the present embodiments, reference is made to the accompanying drawings that form a part hereof, and in which is shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

To reduce bandwidth requirements in pulse modulated micro-displays, the pixels are typically driven using a binary weighed time period of bit planes rather than a time based pulse width modulated scheme that would require faster data updating for every least significant bit duration. However, in series based modulator systems, this binary weighted modulation can produce undesired visual artifacts such as visual discontinuities at pixel boundaries.

A "visual discontinuity" occurs due to the binary weighting of bits when two PMM modulators are coupled in a series arrangement. The discontinuity occurs due to binary weighting of the pulses and when there is an overlap of pixels due to misalignment or imperfect imaging of the two modulators in series. If one pixel on a modulator is partially overlapping an adjacent pixel on the other modulator and their two binary weights are complimentary (that is, one is ON and the other is OFF) the result is that the overlapped area will be OFF due to the inherent "AND" function of the series architecture. While for a particular bit time, the error is minor, over the entire period used to display a pixel's entire binary weighted value, the aggregated result can be large.

Figure 7:
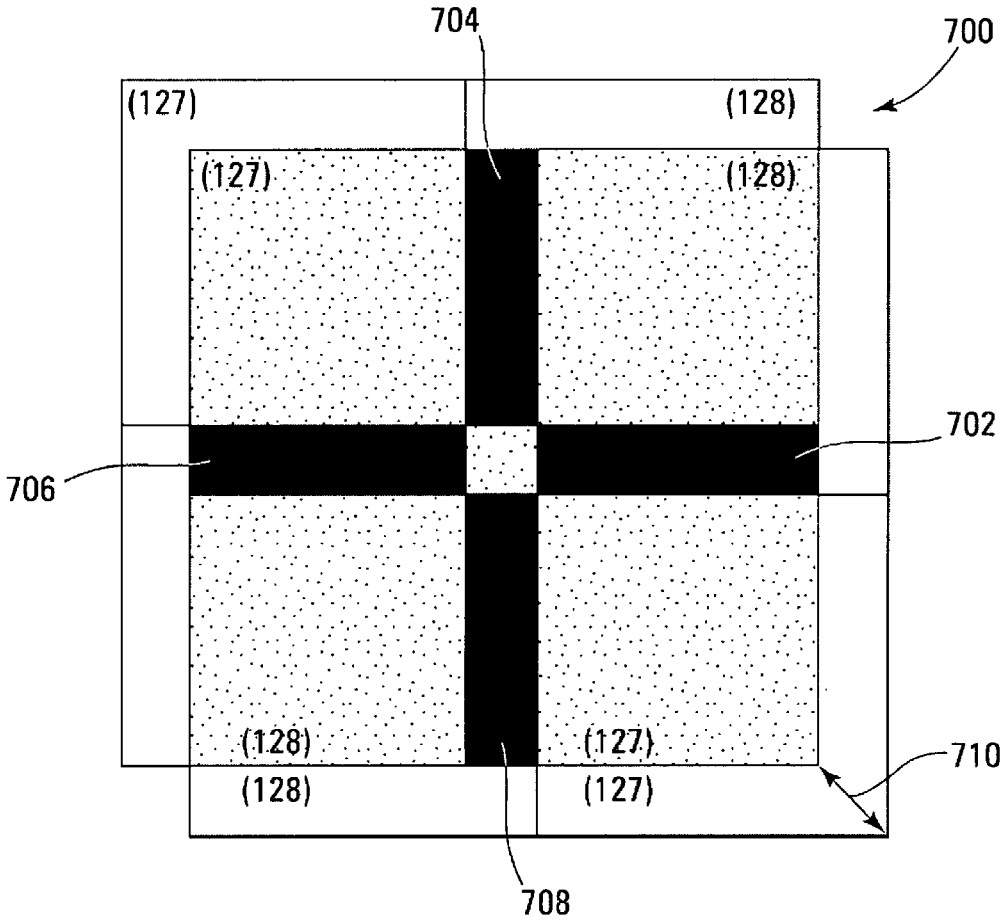
FIG. 7 illustrates an exemplary system of two modulators in series in which there is a misalignment of pixels.

FIG. 7 illustrates an exemplary system 700 of two modulators in series in which there is a misalignment of pixels in an extreme case. Shown are four pixels of each modulator which are misaligned by a distance 710. The upper left and lower right pixels of each modulator are driven with a data value of 127 (01111111 binary) out of a possible 255 max value. The upper right and lower left pixels of each modulator are driven with a data value of 128 ( 10000000 binary) out of a possible 255 max value. Visual discontinuities 702, 704, 706 and 708 occur when the pixels driven with a binary weighted 127 overlap a pixel driven with a binary weighted 128 value. When the two binary weighted timings are overlapped due to the series architecture, the resultant gating of light is a data value of zero (00000000 binary).

For instance, if a first pixel is to display a grey scale of 128 (out of 255 max for an 8 bit system) and the second pixel is to display a grey scale of 127, the resultant visual discontinuity is perceived as an OFF segment where the two pixels overlap. This result is due to the grey scale 128 being '10000000' binary and grey scale 127 being '01111111' binary and when "ANDed" due to the overlap, the resulting grey scale being '00000000'. In this extreme example, since the grey scale 128 and the grey scale 127 are about one half of the full on brightness, visual discontinuities of no brightness or slivers of "OFF" where the pixels overlap results in the image having a very noticeable defect.

In order to reduce the visual discontinuities of conventional binary weighted bit plane drive algorithms, a new algorithm is used which "hybridizes" the timing used to pulse modulate the pixels on PMM modulators. That is, the period used to pulse modulate the pixel is broken up into a binary weighted section and a time weighted section. The binary weighted section is dedicated to the lower order bits to minimize the number of data loads. The time weighted section is dedicated to the higher order bits to minimize the amount of time that a discontinuity can occur. Since in most PMM systems, the higher order bits are broken up to reduce other artifacts, a similar number of data loads can be preserved as in a conventional PMM system. The difference with the new hybridized scheme is that the higher order bits are enabled using Boolean logic to convert from binary weighting to time weighting thus reducing the amount of time a visual discontinuity might occur.

Using the previous example, rather than having eight binary weighted times, one might have a hybridized period having 6 binary weighted times for the lower order 6 bits (bits 0-5) and 3 time weighted times for the two higher order bits (bits 6-7). Each of the 3 time weighted times would be for a period of the binary weight of the lesser two higher bits. That is, the higher order bit times rather than being binary weighted are divided up into time segments equal to the binary weight of the lesser order higher bit. In this example, the lesser order bit is bit 6 and bit 7 is divided into two time periods equal to the binary weight time of bit 6. Thus, rather than eight data loads, there would be nine data loads. However, in a conventional PMM system, bit 7 is usually broken up (known as bit splitting) to reduce color tearing and motion artifacts. For hybridized systems, the data loaded is determined from Boolean logic to be time weighted such as in conventional pulse width modulation by using logical combinations of the bits 6 and 7. The first hybrid time period is set to the logical value of bit 6 OR bit 7, the second hybrid time period is set to the logical value of bit 7, and the third hybrid time period is set to the logical value of bit 6 AND bit 7. In this example the grey scale value of 128 would be "011|000000" (where | indicates the separation of the fixed hybrid time (left) and binary weighted time (right) periods) and the grey scale value of 127 would be "001|111111".

Where the two pixels overlap, the inherent ANDed value would now be "001|000000" which is half-way between the two grey scale values but better than a complete OFF as with binary weighted values and thus less noticeable. Of course, the value can more closely approximate the desired grey value by using more hybridized time weighted bits and less binary weighted bits. More detail into how the hybridized bit planes are created and used follows in the following description of FIGS. 1-6.

Figure 1:
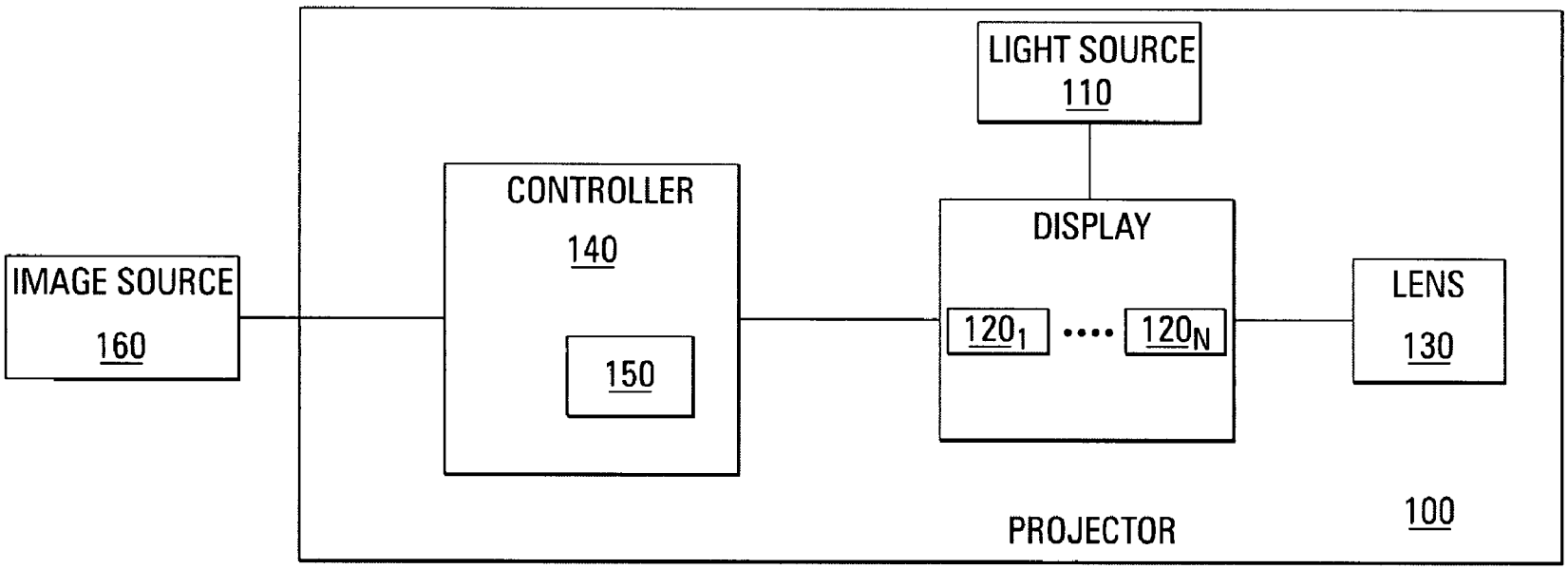
FIG. 1 is an embodiment of a projector, according to an embodiment of the present disclosure.

FIG. 1 is a block diagram of a digital projector 100, such as is used in rear or front projection systems, according to an embodiment. Digital projector 100 includes a light source 110, micro-displays 120, and a projection lens 130. Micro-displays 120 receive light from light source 110, and projection lens 130 magnifies micro-displays 120. Each of micro-displays 120 includes an array of pixels. When the pixels of a micro-display 120 are ON, the pixels direct the light to projection lens 130. When the pixels are OFF, they produce a "black" state by not directing light to projection lens 130. For one embodiment, micro-displays 120 are operated in series, e.g., for enhancing projector 100's black/white contrast ratio, often defined as the ratio of the light imaged by the projection lens when all of the pixels in the micro-display are ON to the light imaged by the projection lens when all of the pixels are OFF. For another embodiment, micro-displays 120 are pulse modulated.

Projector 100 also includes a controller 140 for controlling the operation of micro-displays 120. For one embodiment, controller 140 controls the modulation of micro-displays 120. For another embodiment, controller 140 is adapted to perform methods in accordance with embodiments of the present disclosure in response to computer-readable instructions. These computer-readable instructions are stored on a computer-usable media 150 of controller 140 and may be in the form of software, firmware, or hardware. In a hardware solution, the instructions are hard coded as part of a processor, e.g., an application-specific integrated circuit (ASIC) chip, a field programmable gate array (FPGA), etc. In a software or firmware solution, the instructions are stored for retrieval by controller 140. Some additional examples of computer-usable media include static or dynamic random access memory (SRAM or DRAM), read-only memory (ROM), electrically-erasable programmable ROM (EEPROM or flash memory), magnetic media and optical media, whether permanent or removable.

Controller 140 receives digital data, for example, from an image source 160, such as a computer display output, DVD player, a set-top box connected to a direct television satellite link, or a cable television provider, etc. For one embodiment, projector 100 receives analog data from image source 160 and then digitizes and manipulates this data in order to provide digital data to controller 140. For some embodiments, controller 140 formats the digital data in a multiple bit format, such as an eight bit per color format, e.g., eight bits for each of the colors red, green, and blue. The multiple bit format may be converted to a hybridized bit format as describe herein to reduce visual discontinuities. Each of the micro-displays 120 displays one bit of the hybridized data on each of their pixels for an allotted time period determined by its binary weight or by a time based weight. For example, when the level of a bit is a logic HIGH the pixel is ON or active for its allotted time, and when the level of a bit is a logic LOW the pixel is OFF or inactive for its allotted time.

Figure 2:
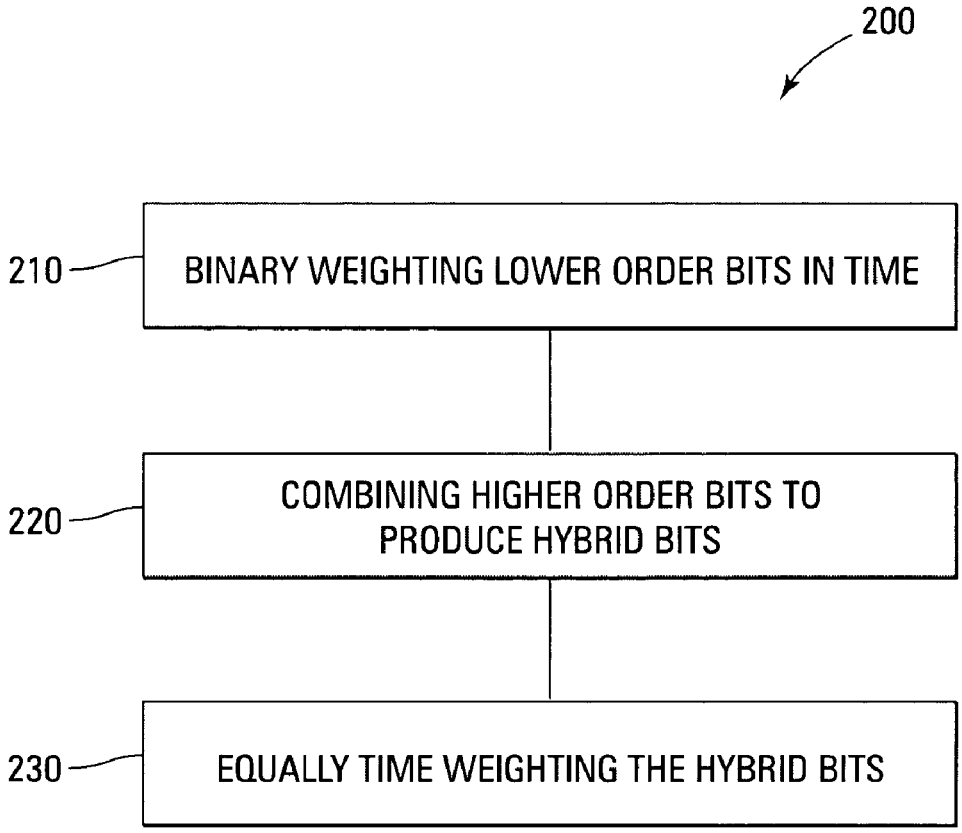
FIG. 2 is a flowchart of an embodiment of a method, according to another embodiment of the present disclosure.

FIG. 2 is a flowchart of a method 200, according to another embodiment. At block 210, the lower order bits of the digital data, e.g., all of the bits except for the two or three highest order bits, are binary weighted in time. That is, active lower order bits are ON or displayed according to their bit level based on a time period that is based on their binary weight. For example, bit 1 would be displayed for twice as long as bit 0, bit 2, four times as long as bit zero, etc. In one embodiment with eight bits per color and a 60 Hz frame rate, bit 0 is displayed for 21.7 microseconds.

At block 220, active upper order bits, such as bits 6 and 7 or bits 5, 6, and 7 of an 8-bit format, are combined to produce hybrid bits, and the hybrid bits are equally weighted in time at block 230. That is, each of the hybrid bits are displayed for a time duration corresponding to the time that the lowest order bit used to create the hybrid bits would be displayed if that bit were displayed alone using binary weighting. For example, for combinations of bits 5, 6, and 7, each hybrid bit would be displayed for a time duration corresponding to the time that bit 5 would be displayed if it were displayed alone, i.e., the time duration for which each hybrid bit would be displayed is $2^5$ times that of bit 0.

The higher order bits are combined using Boolean logic to create the hybrid bits. For example, when using two upper bits of an 8 bit system to create 3 hybrid bits, bits 6 and 7 are combined as follows:

$$6 \text{ OR } 7 \text{ OR } (6 \text{ AND } 7) = 6 \text{ OR } 7 \quad (1)$$

$$7 \text{ OR } (6 \text{ AND } 7) = 7 \quad (2)$$

$$(6 \text{ AND } 7) \quad (3)$$

Note that each of the combinations corresponds to a hybrid bit that is displayed for a time duration corresponding to $2^6$ times that of bit 0. Note further that hybrid bit (1) is displayed when bit 6 OR bit 7 is on; hybrid bit (2) is displayed when only bit 7 is ON, and hybrid bit (3) is displayed when bit 6 AND bit 7 are ON. Other mathematical and logical methods of determining the time weighted bits and binary weighted bits can be used and to create the Boolean combinations.

Figure 3:
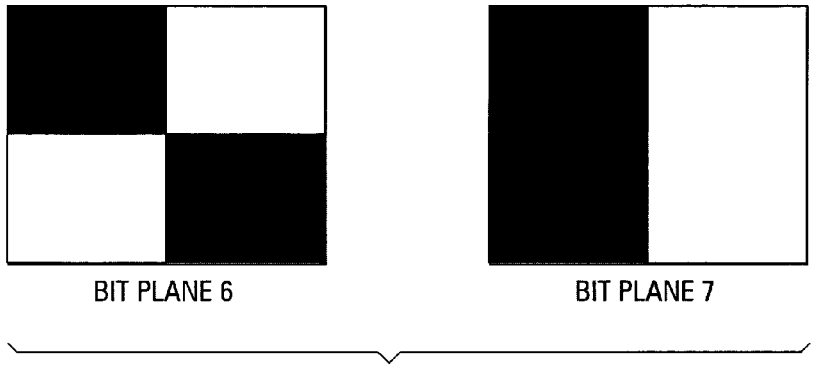
FIG. 3 illustrates exemplary bit planes displayed on a modulator, according to another embodiment of the present disclosure.

FIG. 3 illustrates exemplary bit planes 6 and 7 patterns displayed on a modulator as an array of pixels where a bit plane includes equal order bits for each pixel. That is, bit plane 6 includes a bit 6 for each pixel, and bit plane 7 includes a bit 7 for each pixel. For one embodiment, the white in FIGS. 3-4 corresponds to an ON state or logic HIGH and the black corresponds to an OFF state or logic LOW.

Figure 4:
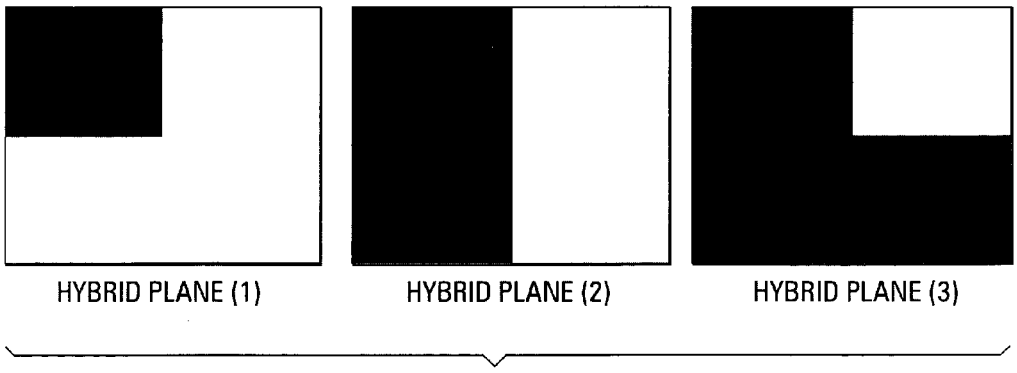
FIG. 4 illustrates exemplary hybrid planes displayed on a modulator produced from combining the exemplary bit planes of FIG. 3, according to another embodiment of the present disclosure.

FIG. 4 illustrates hybrid planes (1), (2), and (3) patterns displayed on a modulator as an array of pixels. The hybrid planes (1), (2) and (3) are generated from bit planes 6 and 7 of FIG. 3, where each hybrid plane includes the same hybrid bits for each pixel. That is, hybrid planes (1), (2), and (3) respectively include hybrid bits (1), (2), and (3) for each pixel. Note that hybrid plane (1) is bit plane 6 ORed with bit plane 7; hybrid plane (2) is bit plane 7; and hybrid plane (3) is bit plane 6 ANDed with bit plane 7.

Each of hybrid planes is displayed for a time duration corresponding to the time duration that bit plane 6 would be displayed in a binary-time-weighted scheme (or time 26 times that of a bit plane 0). For one embodiment, hybrid planes (1), (2), and (3) may be scheduled to display in any temporal order. For another embodiment, one or more of hybrid planes (1), (2), and (3) can be displayed for portions of their respective total display time at different times within a time frame, as long as the portions add up to the total display time. A time frame may be defined as the time in which a frame of data is displayed. For 8 bits per color with three colors, a time frame for a pixel contains $3\times2^8$ bits of data. For a 60 Hz frame rate, a complete time frame is 1/60 seconds (~16.7 ms) in duration thus requiring the least significant bit of each color to be pulsed for ~21.7 micro-seconds. For some embodiments, the lower order bit planes, e.g., bit planes 0-5 for this example, that are binary weighted in time may also be scheduled to display in any temporal order and/or can be displayed for portions of their respective total display time at different times within a time frame, as long as the portions add up to the total display time.

In another embodiment, the three most significant bits of an 8 bit system are hybridized to reduce the amount of "visual distortion" even further. The combinations and hybrid bits for bits 5, 6, and 7 are as follows:

| | |
|---|---|
| 5 OR 6 OR 7 | (1́) |
| 6 OR 7 | (2́) |
| (5 AND 6) OR 7 | (3́) |
| 7 | (4́) |
| (5 AND 7) OR (6 AND 7) | (5́) |
| (6 AND 7) | (6́) |
| (5 AND 6 AND 7) | (7́) |

Figure 5:
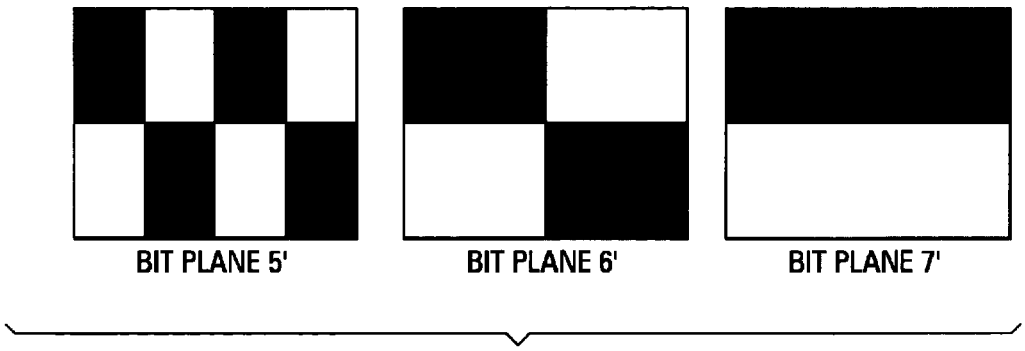
FIG. 5 illustrates exemplary bit planes displayed on a modulator, according to another embodiment of the present disclosure.

FIG. 5 illustrates exemplary bit planes 5́, 6́, and 7́ patterns displayed on a modulator as an array of pixels, according to another embodiment. For one embodiment, the white in FIGS. 5-6 corresponds to an ON state or logic HIGH and the black corresponds to an OFF state or logic LOW.

Figure 6:
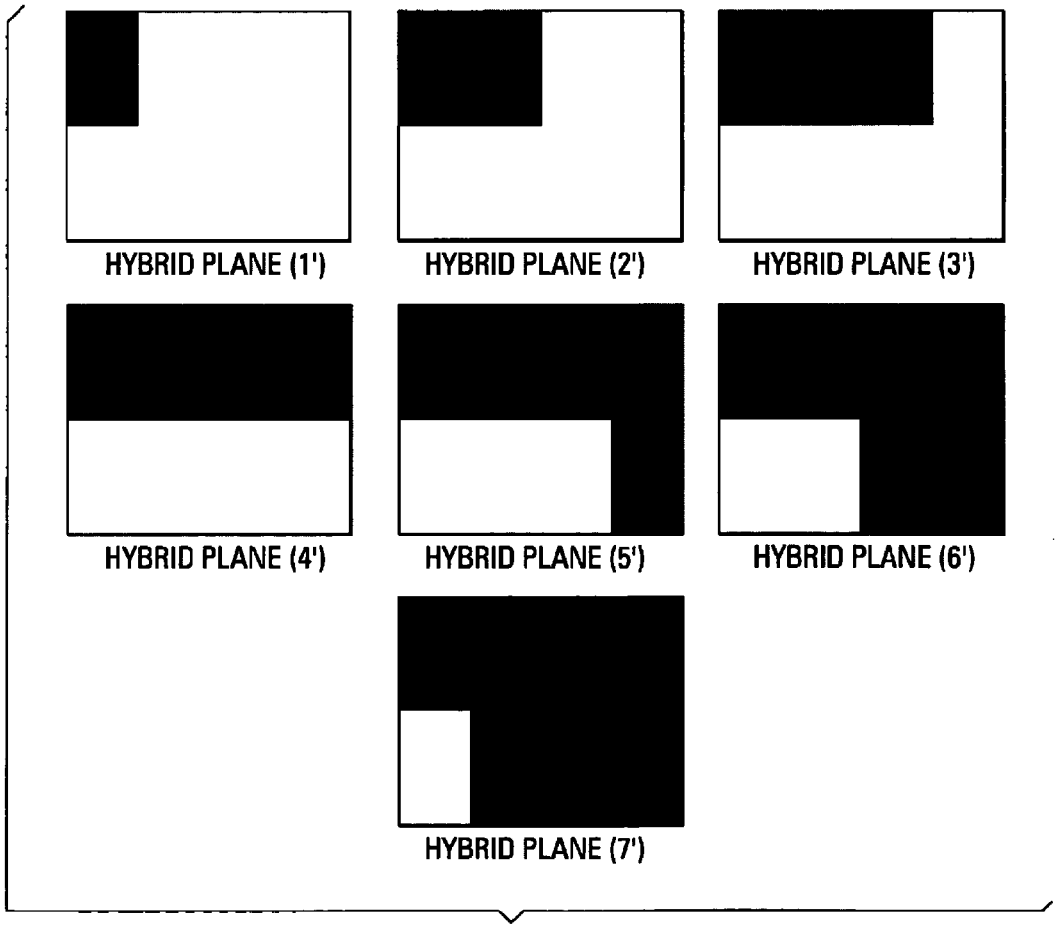
FIG. 6 illustrates exemplary hybrid planes displayed on a modulator produced from combining the exemplary bit planes of FIG. 5, according to another embodiment of the present disclosure.

FIG. 6 illustrates the hybrid plane patterns formed from Boolean combinations displayed on a modulator as an array of pixels thereof in a fashion analogous to producing hybrid bits (1́) to (7́) above. Specifically, ORing bit planes 5, 6, and 7produces hybrid plane (1́); ORing bit planes 6, and 7 produces hybrid plane (2́); ANDing bit planes 5, and 6 and ORing the resulting ANDed combination with bit plane 7 produces hybrid plane (3́); bit plane 7 produces hybrid plane (4́); ANDing bit planes 5 and 7, ANDing bit planes 6, and 7, and ORing the resulting two ANDed combinations produces hybrid plane (5́); ANDing bit planes 6, and 7 produces hybrid plane (6́); and ANDing bit planes 5, 6, and 7 produces hybrid plane (7́).

To display eight bits, for one embodiment, bit planes 0́ to 4́ are scheduled to be displayed sequentially for their respective binary-weighted times. This is sequentially followed by sequentially displaying each of hybrid planes (1́) to (7́) for equal time durations corresponding to the bit-weighted time for bit plane 5́ (e.g. $2^5$ times that of bit 0). Note that the displaying of bit planes 6 to 4 is not limited to sequential displaying according to their bit level, but can be displayed in any order during a frame and/or can be displayed for portions of their total bit-weighted times at different portions of the frame, as long as the portions add up to the respective allotted total display time. In addition, displaying hybrid planes (1́) to (7́) is not limited to sequential display. Moreover, one or more of hybrid planes (1́) to (7́) can be displayed for portions of their total display time at different portions of the frame, as long as the portions add up to their respective allotted total display time. Also note that one or more of hybrid planes (1́) to (7́) may be displayed for their total display time before displaying another of the hybrid planes (1́) to (7́) or one or more of bit planes 0́ to 4́. That is, once the hybrid bit values are determined and their respective times allotted, they and the binary weighted bit values may be displayed in any sequence to reduce any motion or other image artifacts.

It can be seen from above that the number of hybrid bits (or hybrid planes) is $2^n-1$, where n is the number of bits (or bit planes) used in the hybridization.

CONCLUSION

Although specific embodiments have been illustrated and described herein it is manifestly intended that the scope of the claimed subject matter be limited only by the following claims and equivalents thereof.

What is claimed is:

1. A method of operating a projector, comprising:

combining only bit planes of only image data to produce hybrid planes of only image data; and displaying, on at least two modulators of the projector, each of the hybrid planes for equal time durations corresponding to a binary-weighted time of the lowest bit level of the only bit-planes of only image data;

wherein each hybrid plane is produced by combining only one or more bit planes of the only bit planes of only image data with only one or more other bit planes of the only bit planes of only image data.

2. The method of claim 1, wherein combining only one or more bit planes of the only bit planes of only image data with only one or more other bit planes of the only bit planes of only image data comprises ANDing the only one or more bit planes with the only one or more other bit planes and ORing the only one or more bit planes with the only one or more other bit planes.

3. The method of claim 1, wherein at least one of the hybrid planes is displayed for a portion of its total time duration at different times within a time frame.

4. The method of claim 1, wherein at least one of the hybrid planes is displayed for its total time duration before displaying another of the hybrid planes.

5. The method of claim 1, wherein combining only bit planes of only image data produces $2^n-1$ hybrid planes, wherein n is the number of bit planes of only image data.

6. A method of operating a projector, comprising:

displaying one or more lower order bit planes of only image data on at least two micro-displays in series for binary weighted times;

combining only higher order bit planes of only image data, using Boolean logic, to produce hybrid planes of only image data; and displaying each of the hybrid planes for equal time durations on the at least two micro-displays;

wherein each hybrid plane is produced by combining only one or more higher order bit planes of the only higher order bit planes of only image data with only one or more other higher order bit planes of the only higher order bit planes of only image data.

7. The method of claim 6, wherein the equal time durations correspond to a binary-weighted time of the lowest bit level of the only higher order bit planes of only image data.

8. The method of claim 6, wherein at least one of the hybrid planes is displayed for a portion of its total time duration at different times within a time frame.

9. The method of claim 6, wherein at least one of the hybrid planes is displayed for its total time duration before displaying another of the hybrid planes or one or more lower order bit planes.

10. A method of operating a projector, comprising:

ORing only a first bit plane of only image data with only a second bit plane of only image data to produce a first hybrid plane, wherein the first and second bit planes respectively have the highest and second highest bit levels of a multi-bit pixel plane;

displaying, on at least two modulators in series, the first hybrid plane for a time duration corresponding to a binary-weighted time of the second bit plane;

displaying, on the at least two modulators in series, the first bit plane for the same time duration as the first hybrid plane; ANDing only the first bit plane with only the second bit plane to produce a second hybrid plane; and displaying, on the at least two modulators in series, the second hybrid plane for the same time duration as the first hybrid plane.

11. The method of claim 10 further comprises displaying, on the at least two modulators in series, at least a third bit plane of only image data having a lower bit level than the second bit plane for a binary-weighted time corresponding to its bit level.

12. A method of operating a projector, comprising:

ORing only a first bit plane of only image data, only a second bit plane of only image data, and only a third bit plane of only image data to produce a first hybrid plane, wherein the first, second, and third bit planes respectively have the highest, second highest, and third highest bit levels of a multi-bit pixel plane;

displaying, on at least two modulators in series, the first hybrid plane for a time duration corresponding to a binary-weighted time of the third bit plane;

ORing only the first bit plane with only the second bit plane to produce a second hybrid plane;

displaying, on the at least two modulators in series, the second hybrid plane for the same time duration as the first hybrid plane;

ANDing only the second bit plane with only the third bit plane and ORing only the ANDed second and third bit planes with only the first bit plane to produce a third hybrid plane;

displaying, on the at least two modulators in series, the third hybrid plane for the same time duration as the first hybrid plane;

displaying, on the at least two modulators in series, the first bit plane for the same time duration as the first hybrid plane;

ANDing only the first bit plane with only the third bit plane, ANDing only the first bit plane with only second bit plane, and ORing only the ANDed first and third bit planes with only the ANDed first and second bit planes to produce a fourth hybrid plane;

displaying, on the at least two modulators in series, the fourth hybrid plane for the same time duration as the first hybrid plane;

ANDing only the first bit plane with only the second bit plane to produce a fifth hybrid plane;

displaying, on the at least two modulators in series, the fifth hybrid plane for the same time duration as the first hybrid plane;

ANDing only the first bit plane, only the second bit plane, and only the third bit plane to produce a sixth hybrid plane; and displaying, on the at least two modulators in series, the sixth hybrid plane for the same time duration as the first hybrid plane.

13. The method of claim 12 further comprises displaying, on the at least two modulators in series, at least a fourth bit plane of only image data having a lower bit-level than the third bit plane for a binary-weighted time corresponding to its bit level.

14. A computer-usable medium containing computer-readable instructions for causing a projector to perform a method comprising:

combining only bit planes of only image data to produce hybrid planes of only image data; and displaying, on at least two modulators of the projector, each of the hybrid planes for equal time durations corresponding to a binary-weighted time of the lowest bit level of the only bit-planes of only image data;

wherein each hybrid plane is produced by combining only one or more bit planes of the only bit planes of only image data with only one or more other bit planes of the only bit planes of only image data.

15. The computer-usable medium of claim 14, wherein, in the method, combining only one or more bit planes of the only bit planes of only image data with only one or more other bit planes of the only bit planes of only image data comprises ANDing the only one or more bit planes with the only one or more other bit planes and ORing the only one or more bit planes with the only one or more other bit planes.

16. The computer-usable medium of claim 14, wherein, in the method, at least one of the hybrid planes is displayed for a portion of its total time duration at different times within a time frame.

17. The computer-usable medium of claim 14, wherein, in the method, at least one of the hybrid planes is displayed for its total time duration before displaying another of the hybrid planes.

18. The computer-usable medium of claim 14, wherein, in the method, combining only bit planes of only image data produces $2^n-1$ hybrid planes, wherein n is the number of bit planes of only image data.

19. A computer-usable medium containing computer-readable instructions for causing a projector to perform a method comprising:

displaying one or more lower order bit planes of only image data on at least two micro-displays in series for binary weighted times;

combining only higher order bit planes of only image data, using Boolean logic, to produce hybrid planes of only image data; and displaying each of the hybrid planes for equal time durations on the at least two micro-displays;

wherein each hybrid plane is produced by combining only one or more higher order bit planes of the only higher order bit planes of only image data with only one or more other higher order bit planes of the only higher order bit planes of only image data.

20. The computer-usable medium of claim 19, wherein, in the method, the equal time durations correspond to a binary-weighted time of the lowest bit level of the only higher order bit planes of only image data.

21. The computer-usable medium of claim 19, wherein, in the method, at least one of the hybrid planes is displayed for a portion of its total time duration at different times within a time frame.

22. The computer-usable medium of claim 19, wherein, in the method, at least one of the hybrid planes is displayed for its total time duration before displaying another of the hybrid planes or one or more lower order bit planes.

23. A projector comprising:

a controller configured to cause the projector to perform a method comprising:

displaying one or more lower order bit planes of only image data on at least two micro-displays of the projector in series for binary weighted times;

combining only higher order bit planes of only image data, using Boolean logic, to produce hybrid planes of only image data; and displaying each of the hybrid planes for equal time durations on the at least two micro-displays;

wherein each hybrid plane is produced by combining only one or more higher order bit planes of the only higher order bit planes of only image data with only one or more other higher order bit planes of the only higher order bit planes of only image data.

24. The projector of claim 23, wherein, in the method, the equal time durations correspond to a binary-weighted time of the lowest bit level of the only higher order bit planes of only image data.

25. The projector of claim 23, wherein, in the method, displaying each of the hybrid planes for equal time durations on the at least two micro-displays acts to reduce discontinuities resulting from misalignment of the at least two micro-displays.

26. The projector of claim 23, wherein the at least two micro-displays are adapted to be pulse modulated.

27. A projector comprising:

a controller configured to cause the projector to perform a method comprising:

combining only bit planes of only image data to produce hybrid planes of only image data; and displaying, on at least two micro-displays of the projector, each of the hybrid planes for equal time durations corresponding to a binary-weighted time of the lowest bit level of the only bit-planes of only image data;

wherein each hybrid plane is produced by combining only one or more bit planes of the only bit planes of only image data with only one or more other bit planes of the only bit planes of only image data.

28. The projector of claim 27, wherein, in the method, combining only one or more bit planes of the only bit planes of only image data with only one or more other bit planes of the only bit planes of only image data comprises ANDing the only one or more bit planes with the only one or more other bit planes and ORing the only one or more bit planes with the only one or more other bit planes.

29. The projector of claim 27, wherein, in the method, combining only higher order bit planes comprises combining only higher order bit planes using Boolean logic.

30. The projector of claim 27, wherein, in the method, displaying, on at least two micro-displays of the projector, each of the hybrid planes for equal time durations corresponding to a binary-weighted time of the lowest bit level of the only bit-planes of only image data acts to reduce visual discontinuities resulting from misalignment of the at least at least two micro-displays.

31. The projector of claim 27, wherein the at least two micro-displays are adapted to be pulse modulated.

32. A projector comprising:

a means for combining only bit planes of only image data to produce hybrid planes of only image data; and a means for displaying, on at least two modulators of the projector, each of the hybrid planes for equal time durations corresponding to a binary-weighted time of the lowest bit level of the only bit-planes of only image data;

wherein each hybrid plane is produced by combining only one or more bit planes of the only bit planes of only image data with only one or more other bit planes of the only bit planes of only image data.

33. The projector of claim 32, wherein the only bit planes of only image data are only first bit planes of only image data and further comprising a means for displaying, on the at least two modulators, one or more second bit planes of only image data for binary weighted times, wherein the second bit planes are of lower order than the only first bit planes.

34. A method of operating a projector, comprising:

displaying Boolean combinations of only bit planes of only image data on one or more display devices of the projector;

wherein each Boolean combination is formed using Boolean logic to combine only one or more bit planes of the only bit planes of only image data with only one or more other bit planes of the only bit planes of only image data;

wherein displaying the Boolean combinations of the only bit planes of only image data on the one or more display devices comprises:

displaying the Boolean combinations of the only bit planes of only image data on at least two display devices of the projector;

wherein displaying the Boolean combinations of the only bit planes of only image data on the at least two display devices of the projector acts to reduce an amount of time a visual discontinuity, resulting from misalignment of the at least two display devices, occurs.

35. A projector comprising:

a controller configured to cause one or more display devices of the projector to display Boolean combinations of only bit planes of only image data;

wherein each Boolean combination is only one or more bit planes of the only bit planes of only image data combined with only one or more other bit planes of the only bit planes of only image data;

wherein the one or more display devices comprise at least two micro-displays adapted to operate in series; and wherein the display of Boolean combinations of only bit planes of only image data acts to reduce visual discontinuities resulting from misalignment of the at least at least two micro-displays.

36. A projector comprising:

a controller configured to cause one or more display devices of the projector to display Boolean combinations of only bit planes of only image data;

wherein each Boolean combination is only one or more bit planes of the only bit planes of only image data combined with only one or more other bit planes of the only bit planes of only image data;

wherein the one or more display devices comprise at least two micro-displays adapted to operate in series; and wherein the projector is configured to superimpose the Boolean combinations of only bit planes of only image data respectively displayed on the at least two micro-displays.

* * * * *

UNITED STATES PATENT AND TRADEMARK OFFICE

CERTIFICATE OF CORRECTION

PATENT NO. : 7,768,538 B2
APPLICATION NO. : 11/124795
DATED : August 3, 2010
INVENTOR(S) : Wiatt E. Kettle et al.

It is certified that error appears in the above-identified patent and that said Letters Patent is hereby corrected as shown below:

In column 9, lines 58-59, in Claim 30, before “two” delete “at least”.

In column 10, lines 47-48, in Claim 35, before “two” delete “at least”.

Signed and Sealed this
Twentieth Day of December, 2011

David J. Kappos

David J. Kappos
*Director of the United States Patent and Trademark Office*